United States Patent [19]

Kodama et al.

[11] Patent Number: 4,966,524

[45] Date of Patent: Oct. 30, 1990

[54] BLOWER

[75] Inventors: Tatsuaki Kodama, Yamatokouriyama; Yoshiyuki Takada, Sakurai, both of Japan

[73] Assignee: Matsushita Electric Industrial Co., Ltd., Kadoma, Japan

[21] Appl. No.: 494,958

[22] Filed: Mar. 15, 1990

Related U.S. Application Data

[63] Continuation of Ser. No. 207,633, Jun. 16, 1988, abandoned.

[30] Foreign Application Priority Data

Jun. 18, 1987 [JP] Japan ..... 62-151856
Jun. 26, 1987 [JP] Japan ..... 62-159999

[51] Int. Cl.[5] ..... F04D 29/44

[52] U.S. Cl. ..... 415/223; 165/126; 219/10.55 R; 219/10.55 B

[58] Field of Search ..... 98/1; 165/122, 126; 219/10.55 R, 10.55 B, 10.55 E, 400; 415/209, 211, 216, 217, 182.1, 208.1, 211.2, 223

[56] References Cited

U.S. PATENT DOCUMENTS

| | | | |
|---|---|---|---|
| 2,135,827 | 11/1938 | Marty | 415/209 X |
| 2,176,324 | 10/1934 | Bretzlaff et al. | 415/209 |
| 3,367,566 | 2/1968 | Schulze | 415/209 X |
| 4,152,094 | 5/1979 | Honda et al. | 415/211 X |
| 4,296,297 | 10/1981 | Miller | 219/10.55 R X |
| 4,666,113 | 5/1987 | Itoh et al. | 219/10.55 R X |
| 4,743,728 | 5/1988 | Nagafusa et al. | 219/10.55 R |

FOREIGN PATENT DOCUMENTS

| | | |
|---|---|---|
| 421179 | 10/1968 | Australia . |
| 535984 | 9/1980 | Australia . |

*Primary Examiner*—Harold Joyce
*Attorney, Agent, or Firm*—Cushman, Darby & Cushman

[57] ABSTRACT

A blower for cooling a magnetron and a transformer, provided with an air guide part for collecting the air current vertically blowing outward from the vicinity of an outer periphery of a propeller fan while using a partition plate which adapts the air current to flow in a fixed direction so that the air current increased in directivity and pressure is blown out along a desired direction.

3 Claims, 13 Drawing Sheets

BLOWER

This is a continuation of application Ser. No. 07/207,633, filed June 16, 1988, which was abandoned upon the filling hereof.

FIELD OF THE INVENTION AND RELATED ART STATEMENT

1. Field of the Invention

The present invention relates to an improvement in the blower provided with the propeller fan.

2. Description of the Related Art

Electric apparatuses of these days, particularly those for home use, are directed to ones of reduced size and of smaller weight, more and more pursuant to conveniences for personal uses, portability, and reduced costs.

However, cooling of the electrical parts subjected to heating becomes more difficult as the electric apparatus and parts are reduced in size and imposes a severe limit to designing of the apparatus. In other words, as the parts are reduced in size, surface areas thereof are also reduced and cooling becomes more difficult. On the other hand, as far as efficiency of the apparatus does not change, heat quantity generated thereby is not reduced even if the apparatus is reduced in size. Efficient cooling of the apparatus by means of a more small-sized blower is demanded.

An example of the application of a conventional blower to microwave oven is shown in FIG. 1.

In FIG. 1, the microwave oven provided with the conventional blower comprises: a motor 1, a propeller fan 2 fixed to an end of the shaft of the motor 1, a magnetron 3 for generating microwaves and a transformer 4. These elements are disposed in obliquely forward high and forward low positions with regard to the propeller fan 2 and cooled by the air current generated by the propeller fan 2. The air blowing side of the propeller fan 2 and the air suction side are partitioned from each other by a partition plate 5. An air suction opening 17 is provided in the rear of the motor 1 as well as an exhaust opening 18 on the bottom of the body 100 of the microwave oven.

Generally, as a characteristic of propeller fan, the air current generated by the propeller fan 2 vertically blows out and flows diffusibly outward being influenced by the rotational direction and centrifugal force of the fan.

For example, when the fan 2 rotates in the clockwise direction, as apparent from the sectional front view of the microwave oven shown in FIG. 2, the vertical air current strikes the oven wall 6 on the left side (arrow A1) and most part of the air current flows upward along the oven wall 6 (arrow A2).

The magnetron 3 is required to be disposed generally in the approximate middle position of the depth of the oven in connection with the distribution of microwaves. Therefore, most of the air current flowing distantly in relative position from the propeller fan 2 and long the oven wall 6 as shown in FIG. 2 escapes without being utilized for cooling the magnetron 3, whereby cooling efficiency for the magnetron 3 is low.

A model diagram of distribution zones I and II of the strong air current generated by and ahead of the propeller fan 2 is shown in FIG. 3.

If any obstacle lies ahead of the propeller fan 2, the distribution of the strong air current zone is as shown at I by the continuous line (solid line). When the magnetron 3 as an obstacle is located ahead of the propeller fan 2 as shown by the broken line, the strong air current zone changes as shown at II by the one-dotted chain line, that is, the air current flows to escape from an obstacle (magnetron), since it makes a high resistance to the air current. Therefore, efficient cooling of the magnetron 3 having a high resistance to the air current has been difficult as far as the conventional blower is utilized and, further, cooling of the transformer 4 which is distant from the propeller fan 2 has been more difficult than that of the magnetron. To remove such difficulties, for example, an attempt has been made to control the air current so that the air current is concentrated on the portion requiring cooling by the use of guides 19 and 20 provided below an air guide 7 and above the magnetron 3, respectively, as shown in FIG. 1. But substantial directional change of the air current has been impossible by such means, and in some cases, the air current was made stagnant on the contrary, whereby satisfactory cooling effect has been unobtainable.

FIGS. 4 and 5 show a microwave oven employing a conventional blower of another type. In this oven, microwaves generated by the magnetron 3 are stirred by a stirrer 11 which is rotated by the air current power. A waveguide 13 serves to guide microwaves generated by the magnetron 3 into the center part of the cooking chamber **100*b* of the microwave oven 100 and, further, into the stirrer chamber 12 through an opening 14**.

In FIG. 4, a part of the air current blown from the propeller fan 2 strikes and cools the magnetron 3 as shown by the arrow mark B1. Afterward, such a part of the air current as above (arrow B2) further flows into the stirrer chamber 12 disposed high in the oven 100 through the air guide 7. The remaining part of the air current (arrow B3) that has cooled the magnetron 3 flows into the inside **100*a* of the oven 100 through the louvers 8*a* and 8*b* of the air guide 7. The air current (arrow B2) having flowed into the stirrer chamber 12 strikes the blades 11*a* of the stirrer 11 as shown in FIG. 5 to drive the stirrer 11 in the arrow direction B5 and then is exhausted outside from the stirrer chamber 12 through the louver 8*c*. On the other hand, the air current (arrow B3) conducted into the inside 100*a* of the oven 100 is exhausted therefrom through an exhaust opening 18 after performing inside ventilation (arrow B4 of FIG. 4**).

In this conventional blower, too, a quantity of the air current striking the magnetron 3 is small and obliged to ventilate the inside **100*a* of the oven and to drive the stirrer 11. Accordingly, because of a limit imposed on designing, such a structure as above has been employed for only the microwave oven of small size. In addition, a small quantity of the air current to drive the stirrer 11 requires an enlargement of blades 11*a* of the stirrer 11 and renders the space of the stirrer chamber 12 to be large. Thereby, a problem of reduction in effective volume of the cooking chamber 100*b* of the oven 100 is inevitable. Enlargement of the blades of the stirrer 11 makes it difficult to balance the stirrer 11 in rotation. When this microwave oven is used in a district where the power supply is poor, the drop of voltage of the power source lowers air blowing capacity of the propeller fan 2**. As a result, there are problems as an insufficient quantity of air current, less revolution of the stirrer, and unsatisfactrory output of capacity of the microwave oven.

OBJECT AND SUMMARY OF THE INVENTION

This invention, in view of such backgrounds as above, is to provide a blower in which the air current blown forward from the propeller fan is utilized as it is and a part thereof blown outward diffusively from the outer peripheral area of the fan and has hitherto been wasted is turned to flow in the desired direction.

A blower in accordance with the present invention comprises:

a propeller fan;

a partition plate for partitioning an air suction side (upstream side) of the propeller fan and an air blowing side (downstream side) from each other;

air current receiving means provided on the partition plate and in a downstream side of the propeller fan for receiving the air current blown out from the outer peripheral area around the blades of the propeller fan; and air guide means for guiding the air current received by the current receiving means in a desired direction.

While the novel features of the invention are set forth particularly in the appended claims, the invention, both as to organization and content, will be better understood and appreciated, along with other objects and features thereof, from the following detailed description taken in conjunction with the drawings.

According to the structure as described above enables blowing of the air current in the desired direction by utilizing such nature of the air current of propeller fan that the air moves non-straight, which nature has been regarded as a defect of the propeller fan. That is, by utilizing the nature of vertical flow of the air current due to the rotation of fan and outward diffusive flow caused by the centrifugal force. Therefore, cooling of plural parts which are disposed spatially distant from each other can be made efficiently and by a single fan. Further, the air current that has hitherto been wasted can be effectively utilized and provide a substantial improvement in efficiency of the blower.

DESCRIPTION OF THE PREFERRED EMBODIMENTS

Figure 6:
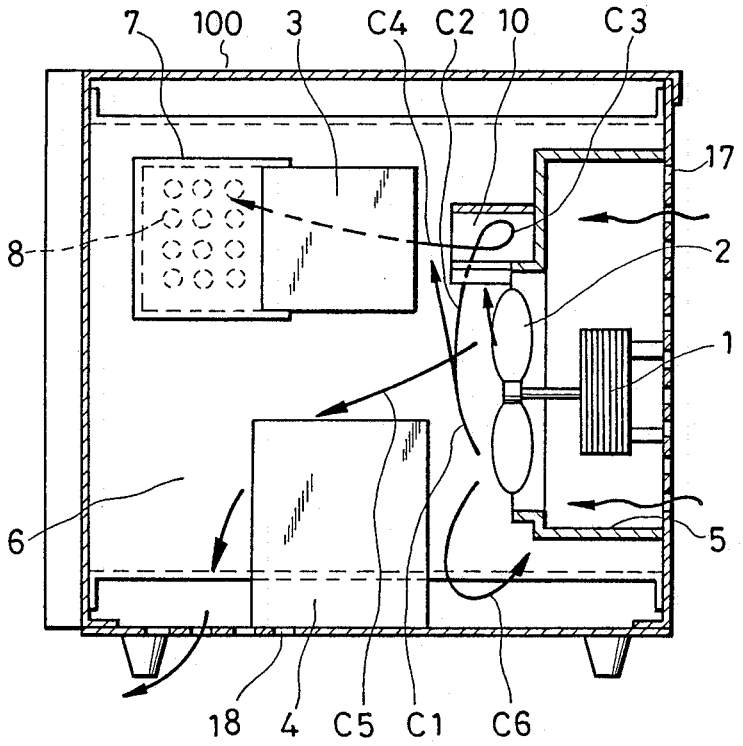
FIG. 6 is a sectional side view of an example of a blower embodying the present invention.
Figure 7:
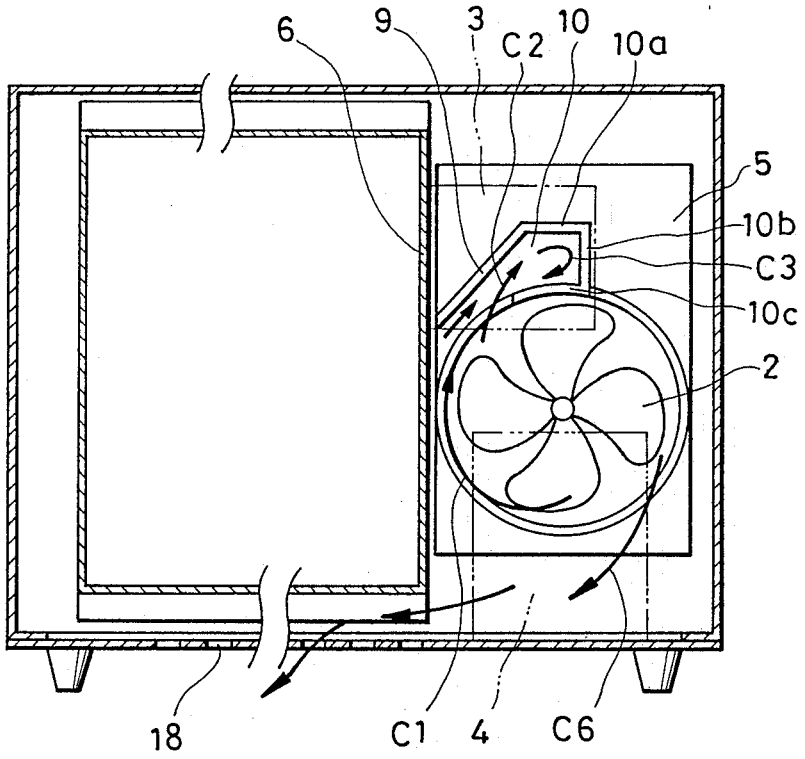
FIG. 7 is a sectional front view thereof.

An embodiment of this invention will be described with reference to the drawings hereunder. FIGS. 6 and 7 shown a microwave oven provided with a blower apparatus embodying the present invention.

In FIG. 6, a microwave oven employing a blower apparatus of this invention comprises: a motor 1, a propeller fan 2 fixed to an end of the shaft of the motor 1; a magnetron 3 for generating microwaves; and a transformer 4. These elements are disposed in the obliquely forward high and forward low position with regard to the propeller fan 2 and cooled by the air current generated by the propeller fan 2. The air blowing side and the air suction side of the propeller fan 2 are partitioned by a partition plate 5. An air suction opening 17 and an air exhausting opening 18 are provided in the rear of the motor 1 and below the oven 100, respectively.

Figure 8:
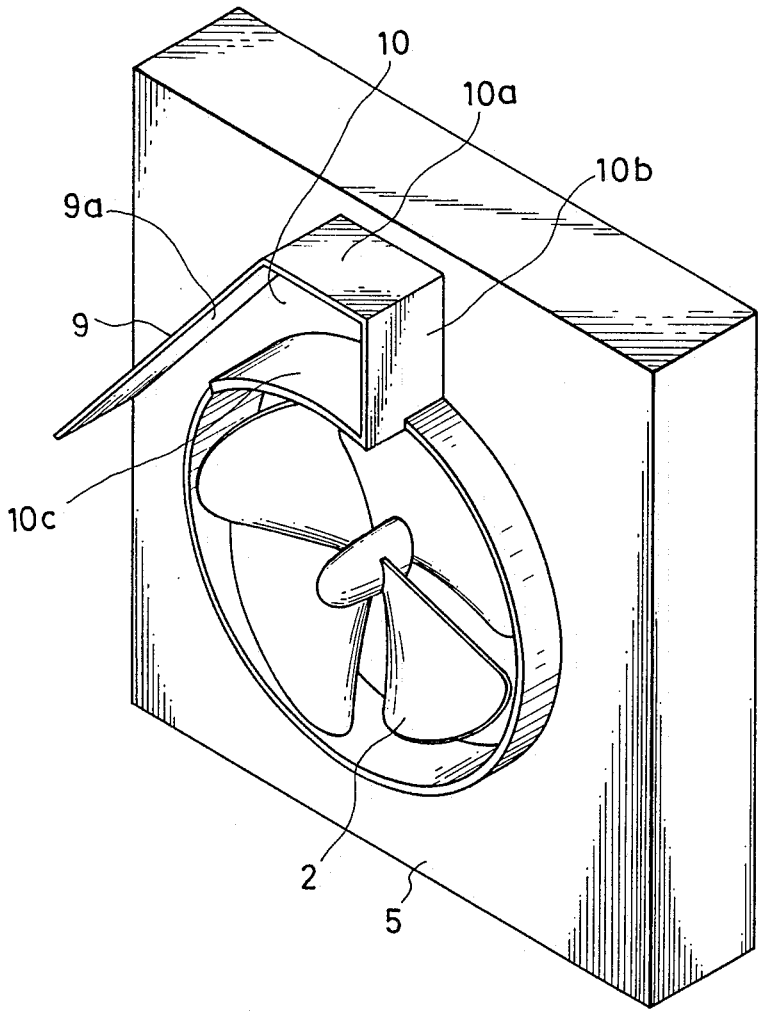
FIG. 8 is perspective view of an example of a blower embodying the present invention.

As a characteristic of propeller fan, the air current generated by the propeller fan 2 is subjected to influence of the rotation and the centrifugal force of the fan blades, and hence vertically blows out and flows outward diffusively. As shown in FIGS. 7 and 8, therefore, an air current receiving plate 9 is provided on the partition plate 5 in such manner as projecting obliquely toward the air blowing side of the propeller fan 2. On one end of the current receiving plate 9, an air compressing chamber 10 composed of a horizontal wall **10*a*, a vertical wall 10*b*, and an arcuate wall 10*c* is provided. The current receiving plate 9, at the inner wall 9*a* thereof, receives the air current (arrow C1) blown outward by the centrifugal force from the vicinity of the peripheral area around the blades of the propeller fan and guides it into the air compressing chamber 10 (arrow C2). The horizontal wall 10*a* of the air compressing chamber 10 turns the air current having flowed along the current receiving plate 9 (arrow C2) to flow in the horizontal direction (arrow C3) and the current having been turned to flow in the horizontal direction (arrow C3) is turned by the vertical wall 10*b* and partition plate 5 for conducting the air stream in the direction indicated by the arrow C4, i.e., toward the space ahead of the propeller fan 2. The arcuate wall 10*c* prevents the air current in the compressing chamber 10 from flowing backward to the propeller fan 2**.

Such a structure as above enables effective use of the upwardly escaping air current that has hitherto been wasted, and the air current blown from the air compressing chamber has a sharp directivity and pressure (i.e. high in flowing speed). An appropriate positioning of the blowing opening of the air compressing chamber enables blowing of the air current in the desired direction. In FIGS. 6 and 7, the air current coming from the air compressing chamber 10 strikes and cools the magnetron 3. On the other hand, the transformer 4 provided on the bottom of the microwave oven 100 is cooled by the air current (arrows C5 and C6) blown directly from the propeller fan 2. As a result, the magnetron 3 and the transformer 4, which are spatially distant from each other, are cooled efficiently and simultaneously by a single propeller fan 2.

A microwave oven employing a blower of another embodiment of this invention will be described with reference to FIGS. 9, 10 and 11.

Figure 9:
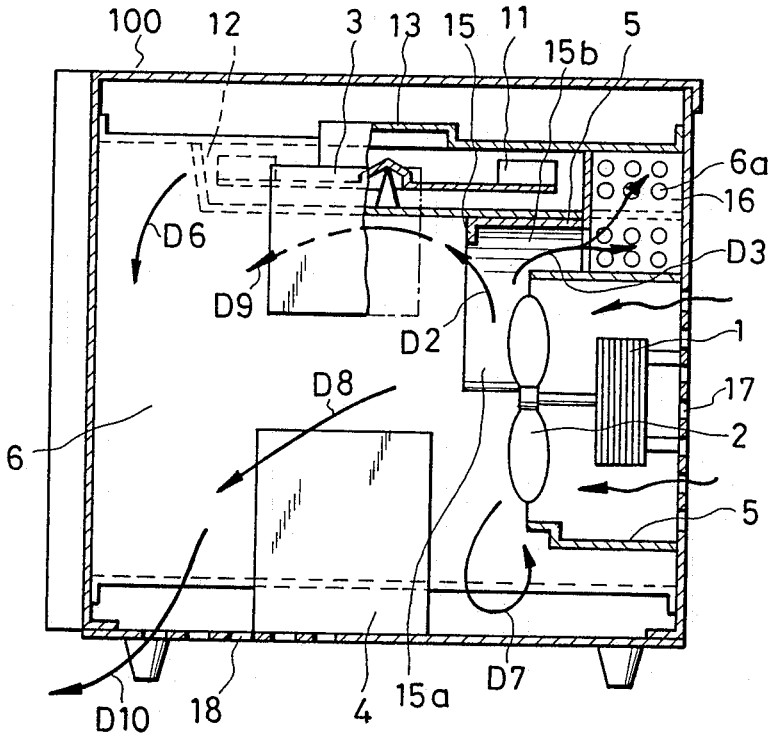
FIG. 9 is a sectional side view of a microwave oven provided with another example of a blower embodying the present invention.

FIG. 9 is a sectional side view of the microwave oven provided with a blower of this invention; FIG. 10 is a sectional top view thereof; and FIG. 11 is a perspective view of the blower. A description of the component members indicated by the same reference numerals as those used in the embodiment shown in FIGS. 6, 7 and 8 is omitted because of the identity between these respective members.

Figure 10:
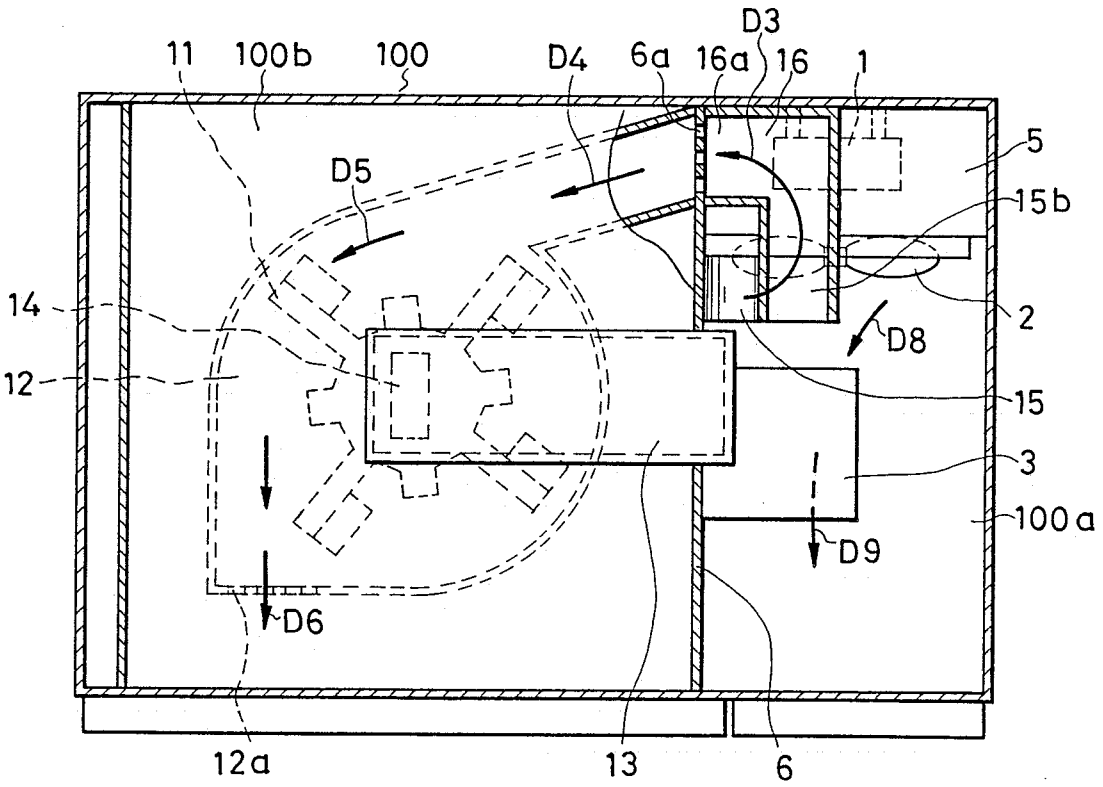
FIG. 10 is a sectional top view thereof.
Figure 11:
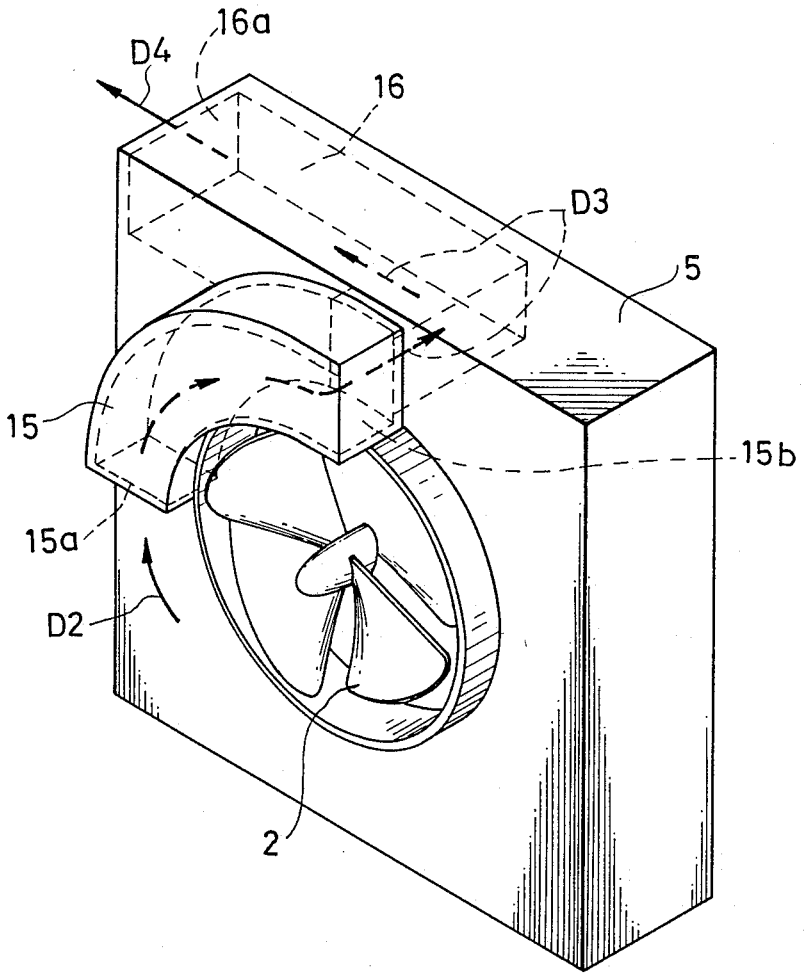
FIG. 11 is a perspective view of the blower thereof.

Referring to FIGS. 9 through 11, an arcuate duct 15 is provided on the upper part of the partition plate 5 so that an opening 15*a* of the duct is disposed in the upper front of the propeller fan 2. In other words, the air current vertically blown from the propeller fan 2 is guided into the duct 15 through the opening 15*a* thereof (arrow D2) and, further, through the interior space 15*b* of the duct 15 serving as a current guide tube, into the air compressing chamber 16 (arrow D3) provided above the partition plate 5. An air blowing opening 16*a* of the air pressuring chamber 16 faces to an opening 6*a* provided on the side wall 6 of the oven 100 and the air current having been blown from the compressing chamber 16 is guided into the stirrer chamber 12 provided in the heating chamber 100*b* of the oven 100 (arrow D4). The stirrer 11 is rotated by the air current guided into the strirrer chamber 12 (arrow D5) and microwaves generated by the magnetron 3 and supplied into the stirrer chamber 12 through the waveguide 13. And an opening 14 thereof are evenly stirred by the stirrer 11 to evenly heat food placed in the heating chamber 100*a* of the oven 100. The air current introduced into the stirrer chamber 12 is exhausted through an opening 12*a* of the chamber 12 (arrow D6). In FIG. 9, the magnetron 3 and the transformer 4 are cooled by, similarly to the conventional apparatus, the air current vortically blown forward from the propeller fan 2 (arrows 7, 8 and 9). The air current blown out from the stirrer chamber 12 (arrow D6) and the other currents (arrows D7, D8 and D9) having cooled the magnetron 3 and the transformer 4 are exhausted through an exhaust opening 18 on the bottom of the oven 100 (arrow D10).

Figure 4:
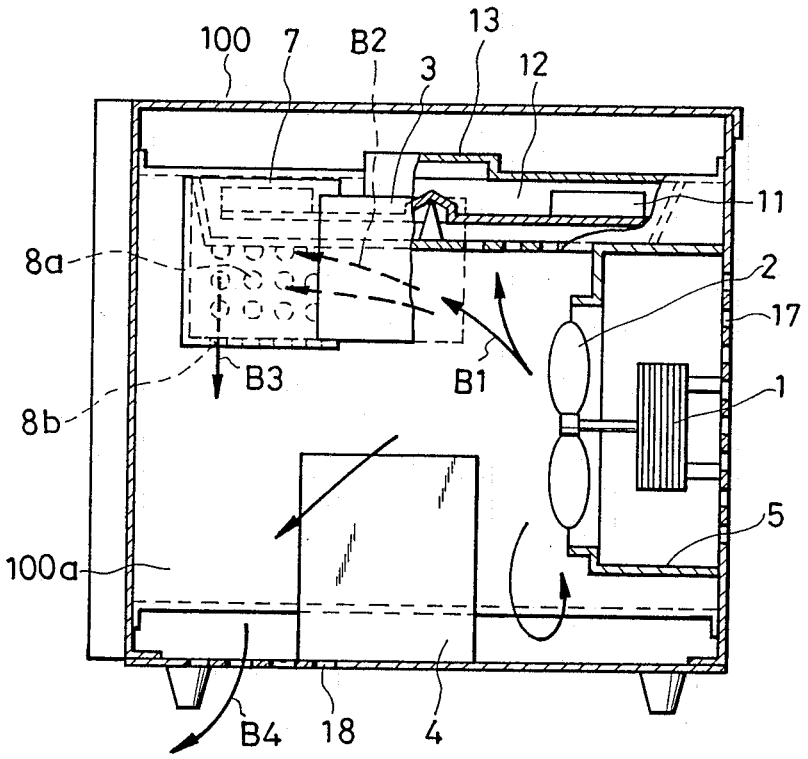
FIG.4 (Prior Art)
FIG. 4 is a sectional side view of a microwave oven provided with another type conventional blower.
Figure 5:
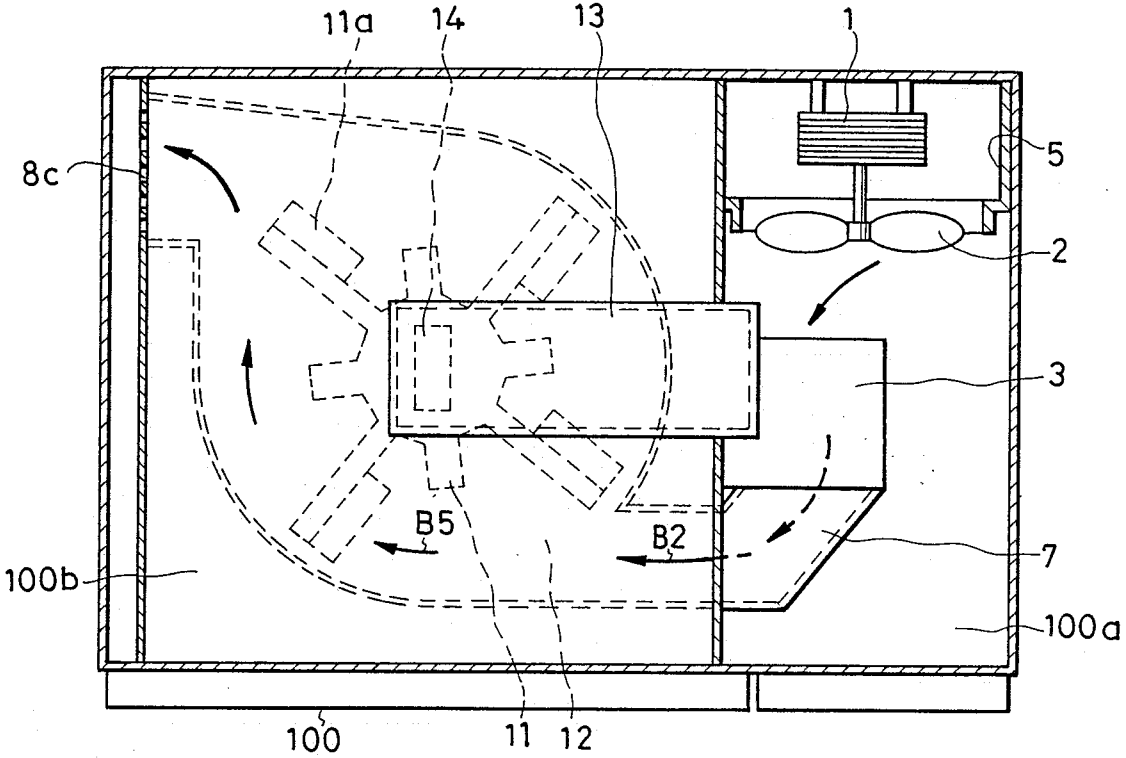
FIG. 5 (Prior Art)
FIG. 5 is a sectional plan view thereof.

In the above embodiment, since the air current which has hitherto been escapable upward along the side wall 6 of the oven 100 is introduced into the stirrer chamber 12 through the duct 15 and the air compressing chamber 16, a sufficient quantity of the air current for rotating the stirrer 11 can be obtained as compared with the conventional blower shown in FIGS. 4 and 5. And thereby, blades 11*a* of the stirrer 11 can be reduced in size. As a result, the stirrer 11 in rotation can easily be balanced and the stirrer chamber 12 reduced in size enables widening of an available space of the heating chamber 100*b* of the microwave oven.

Figure 1:
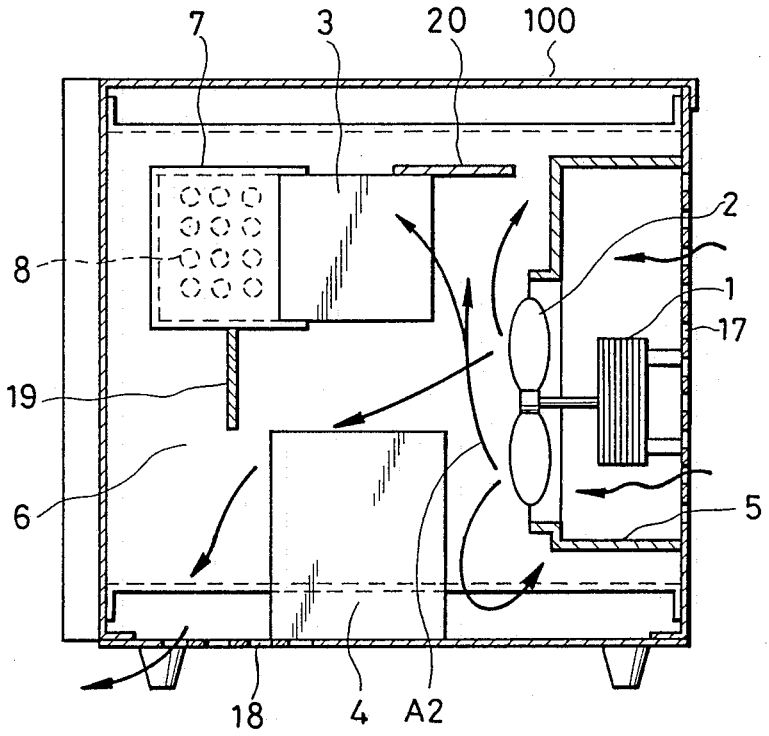
FIG.1 (Prior Art)
FIG. 1 is a sectional side view of a microwave oven provided with the conventional blower.
Figure 2:
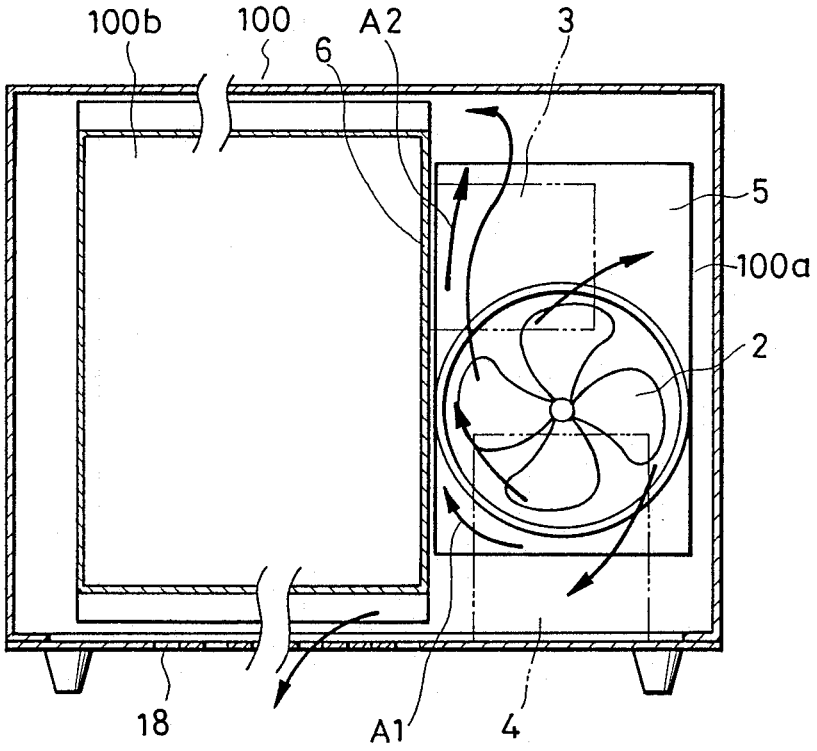
FIG. 2 (Prior Art)
FIG. 2 is a sectional front view thereof.
Figure 3:
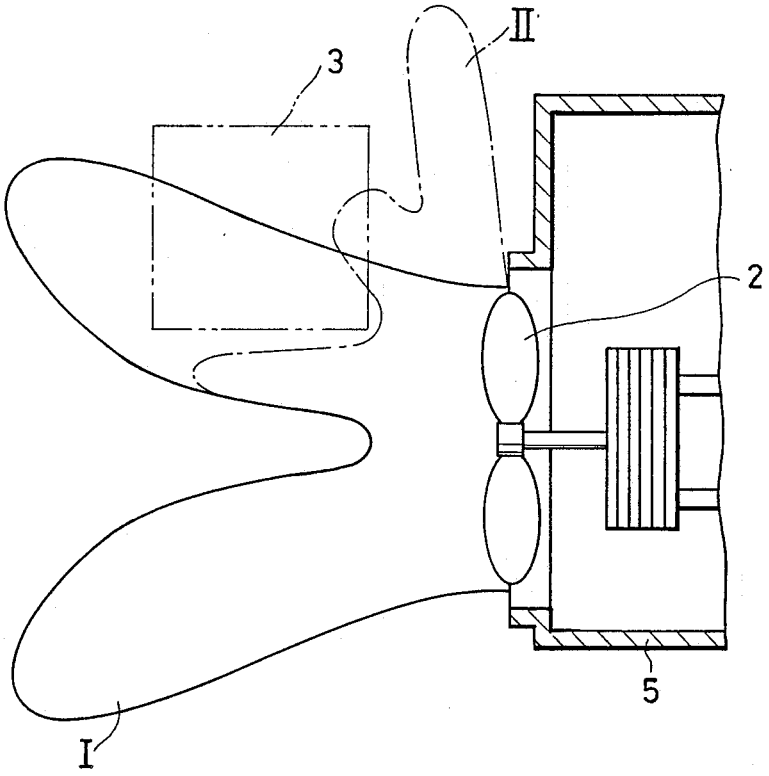
FIG. 3 (Prior Art)
FIG. 3 is a model diagram showing flows of the air current in the conventional apparatus shown in FIGS. 1 and 2.
Figure 12:
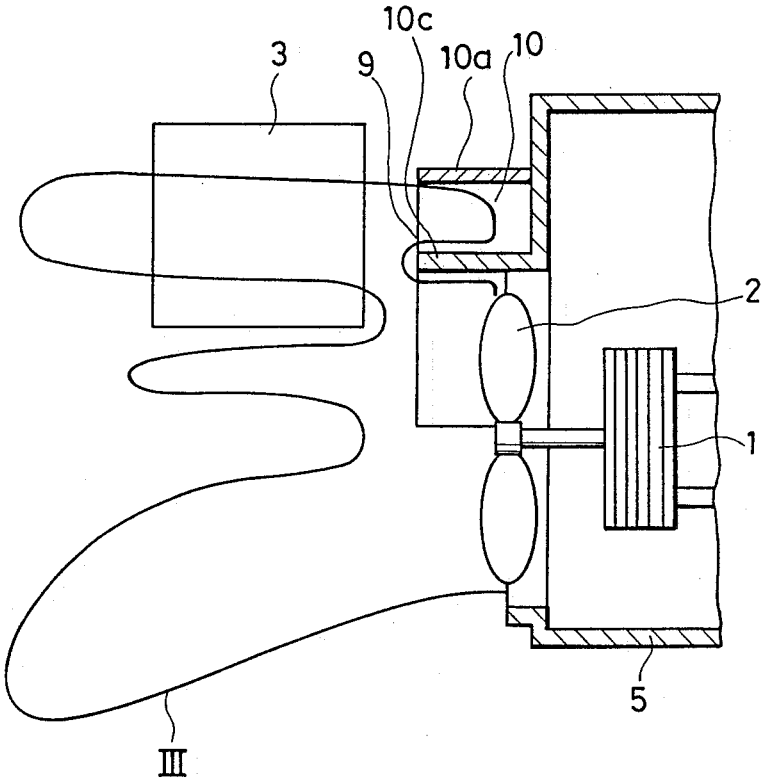
FIG. 12 is a model diagram showing flows of the air current in the blower of the present invention.

FIG. 12 is a model diagram showing the distribution of strong current zone in front of the propeller fan 2. The air current flowing near the outer periphery around the fan blade area is collectively received by the current receiving plate 9 and its directivity is increased so as to be blown from the air pressuring chamber 10 toward the magnetron 3. Therefore, it is apparent that the magnetron 3 can be cooled more effectively than the conventional one having strong air current zones as shown in the distribution diagram of FIG. 3.

Figure 13:
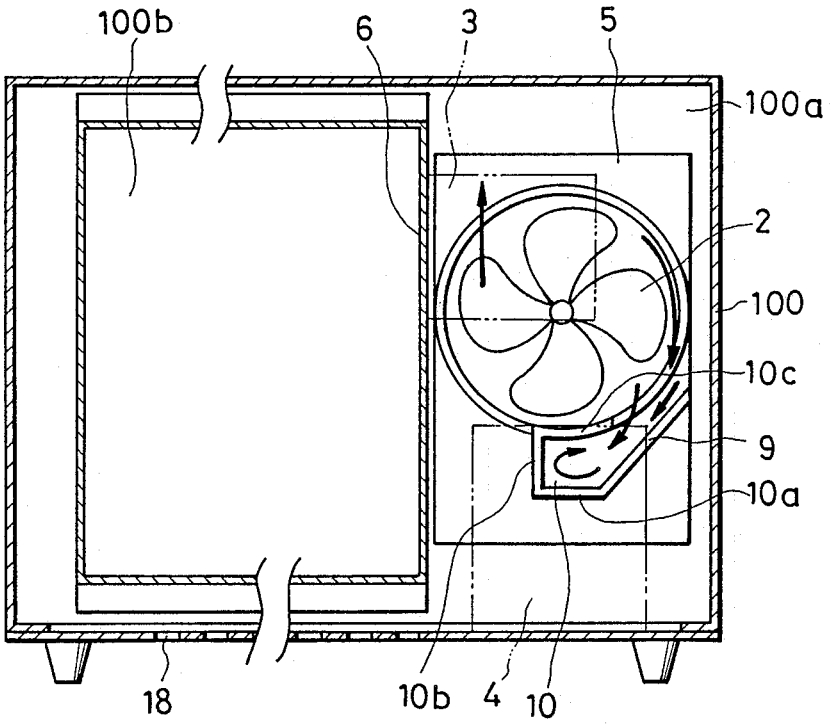
FIG. 13 is a sectional front view of a microwave oven provided with a further example of a blower of the present invention.

FIG. 13 is a sectional front view of a microwave oven employing a blower as another embodiment of this invention, in which the magnetron 3 and the transformer 4 are disposed in obliquely forward positions above and below the propeller fan 2, respectively, in the similar way as that in the embodiment shown in FIGS. 6 through 8.

In this embodiment shown in FIG. 13, the air current receiving plate 9, horizontal wall 10*a*, vertical wall 10*b*, and arcuate wall 10*c* are disposed at a position lower than the rotating shaft of the propeller fan 2, that is, on the side of the transformer 4, contrary to the embodiment shown in FIG. 7. Accordingly, the air current of high directivity and pressure is blown toward the transformer 4, which thereby is effectively cooled.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. A blower comprising:

a propeller fan having blades rotatable about an axis and generating an air current having a first portion having a component blow generally parallel to said axis and a second portion having a component blown generally radially outward of said axis into the peripheral area about said blades;

a partition plate surrounding said fan for partitioning the air sucking side and the air blowing side of said fan from each other;

air current receiving means on said partition plate on said air blowing side of said fan for receiving at least a part of the second air current portion; and air guide means having at least one air current direction-changing wall on said partition plate on said air blowing side of said fan for guiding the air current part received by said air current receiving means and for compressing said air current part and blowing the compressed air out in a direction generally parallel to said axis.

2. A blower comprising;

a propeller fan having blades rotatable about an axis and generating an air current having a first portion having a component blown generally parallel to said axis and a second portion having component blown generally radially outward of said axis into the peripheral area about said blades;

a partition plate surrounding said fan for partitioning the air sucking side and the air blowing side of said fan from each other;

air current receiving means on said partition plate on said air blowing side of said fan for receiving at least a part of the air second current portion; and air guide means on said partition plate on said air blowing side of said fan for guiding the air current part received by said current receiving means and blowing the air out in a direction generally parallel to said axis.

3. The blower defined by claim 2 including means defining an air compressing chamber adjacent the downstream end of the air guide means for collecting the air current and increasing the pressure thereof before the air is blown out.

* * * * *